United States Patent [19]

Schaefer

[11] 4,373,373

[45] Feb. 15, 1983

[54] AUTOMOBILE BODY REPAIR

[76] Inventor: William J. Schaefer, 3706 Jay La. South, Rolling Meadows, Ill. 60008

[21] Appl. No.: 125,332

[22] Filed: Feb. 28, 1980

[51] Int. Cl.[3] ..... B21D 37/02

[52] U.S. Cl. ..... 72/413; 72/409; 72/461; 81/420; 81/421

[58] Field of Search ..... 72/409, 410, 379, 461, 72/413, 412; 81/418, 420, 421, 422, 423, 424, 425 R, 425 A, 426

[56] References Cited

U.S. PATENT DOCUMENTS

| | | | |
|---|---|---|---|
| 3,617,044 | 11/1971 | Strange | 81/420 |
| 3,808,870 | 5/1974 | Blancett | 81/423 |
| 4,014,226 | 3/1977 | Karamarkovich | 81/426 |
| 4,109,845 | 8/1978 | Wedge | 81/423 |

FOREIGN PATENT DOCUMENTS

| | | | |
|---|---|---|---|
| 451282 | 9/1948 | Canada | 81/423 |

*Primary Examiner*—Gene Crosby

[57] ABSTRACT

An attachment device is disclosed for affixture on pliers having a first and second plier jaw. The device includes a single jaw lug to be secured to the jaw of a standard compound acting adjustable vise type of hand pliers. A piece of sheet metal is introduced between the jaw lug of the device and the opposing jaw of the hand pliers and pressure is applied to the hand pliers. An offset shoulder is displaced along the edge of the piece of sheet metal parallel to the original contour of the piece of sheet metal to form an offset shoulder and edge.

5 Claims, 6 Drawing Figures

AUTOMOBILE BODY REPAIR

BACKGROUND OF THE INVENTION

The invention relates to an attachment for plier type hand tools and more particularly, but not by way of limitation, it relates to a lug attachment for affixture to the upper jaw of a standard compound acting adjustable vise type of hand pliers to depress an offset shoulder and edge along the edge of a piece of sheet metal parallel to the original contour of the said piece of sheet metal for the repair of holes in automobile sheet metal bodies.

SUMMARY OF THE INVENTION

The present invention relates to a sheet metal tool in the form of an attachment device which may be utilized when required by affixture to the upper jaw of a standard compound acting adjustable vice type of hand pliers of any make and size. More particularly, the present invention comprises a jaw lug with the work face of the said jaw lug being so formed that the said jaw lug can be secured to one jaw of the said hand pliers in mating engagement with the opposed jaw of the said hand pliers. The said jaw lug is affixed to the upper jaw of a standard compound acting adjustable vise type of hand pliers by means of set screws to enable rapid assembly and disassembly of the said tool when the exigencies of a particular work operation require.

It is another object of this present invention to make an offset shoulder and edge forming hand tool available to the automobile sheet metal body repair workman without taking up space and adding weight to the standard tool box contents.

Another object of this present invention is to provide an attachment for a standard hand tool that is versatile enough to allow attachment to any standard compound acting adjustable vice type of hand pliers of any made and size.

It is also an object of this present invention to provide an attachment for the said hand pliers that is adjustable to varying guages of sheet metal and also to provide an attachment that is adjustable for varying depths of offset shoulder and edge to be fored on the steel metal edge and which will also provide a long or short radius draw, as required to relieve metal fatigue or as desired by a user for any reason.

It is a further object of this present invention to provide an attachment for the said hand pliers that will form an offset shoulder and edge with each gripping action that is wider than the jaw of the said hand pliers and the said gripping action can be performed with only one hand because of the compound action of the said hand pliers.

It is still another object of this present invention to provide an attachment for the said hand pliers that will provide the same width of work bite while using any size, whether large or small, of the said hand pliers.

It is yet another object of this present invention to provide an attachment for the said hand pliers that can be used by the average person; man, woman, or older child, because the offset shoulder and edge forming operation can be performed by a fairly weak person because of the compound action of the said hand pliers, yet this said device is versatile enough to find a use in the tool box of a sheet metal workman or an automobile sheet metal body repair workman.

It is still another object of this present invention to provide an attachment that will provide a work stop to regulate the width of the edge of the said sheet metal formed into the said offset shoulder and edge to ensure that the said edge will have a smooth and regular contoured shape.

It is yet another object of this present invention to provide an attachment for the said hand pliers that will provide an adjustment means that will allow a user, when working on an automobile sheet metal body hole repair, to control the exact depth of the said offset shoulder and edge that is formed, so that the patch of sheet metal to be used to repair the said automobile body hole will be flush with the contour of the parent metal surrounding the said automobile body hole and automobile body filler will have to be utilized only to fill the aperture around the said patch and to fill the counter-sunk rivet head holes. This said adjustment means will also provide a user with the option of using a gauge of sheet metal that is more sturdy than is the gauge of the said parent metal of the said automobile body.

Other objects and advantages of this present invention will be evident from the following detailed description when read in conjuncton with the accompanying drawings which illustrate this present invention.

DETAILED DESCRIPTION OF THE DRAWINGS

Figure 1:
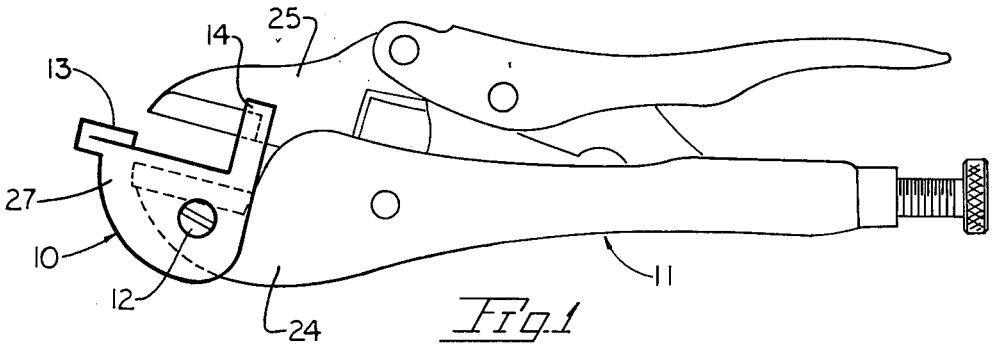
FIG. 1 is a side view of this present device affixed to the upper jaw of a standard compound acting adjustable vice type of hand pliers in an inverted position.

Turning now to the drawings wherein like reference characters refer to like and corresponding parts throughout the several views, FIG. 1 is a side view of the device 10 affixed to the upper jaw 24 of a standard compound acting adjustable vise type of hand pliers 11 in an inverted position. As shown in FIG. 1, the device 10 is affixed to the upper jaw 24 of the said hand pliers 11 by means of two adjustable set screws 12 which are tightened against the said upper jaw 24, with one of these two set screws 12 being hidden from view in back of FIG. 1, but this said hidden set screw 12 is exactly opposed to the said set screw 12 shown in FIG. 1. Also shown in FIG. 1 is the work stop 14 and the offset shoulder and edge forming shelf 13.

Figure 4B:
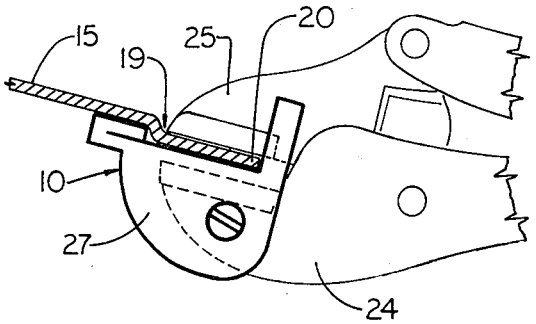
FIG. 4B is the same side view as seen in FIG. 4A, but shows the side view of the said piece of sheet mmtal after pressure is applied to the said hand plier jaws.
Figure 5:
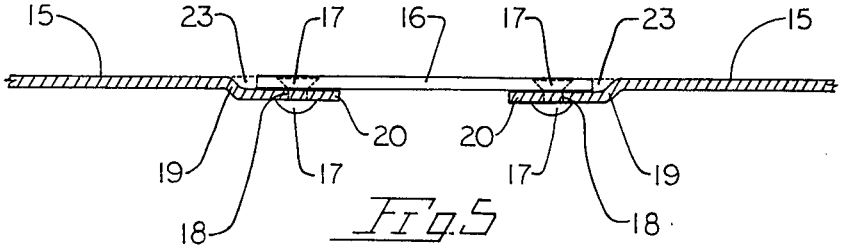
FIG. 5 is a cutaway side view of a piece of sheet metal with a hole in it with a patch of sheet metal inserted into place in the said hole.

The said compound acting adjustable vise type of hand pliers 11 is still free for selection and usage in any of the numerous jobs wherein such a tool becomes a desireable and necessary contributor. In addition, in those circumstances where it is necessary to form an offset shoulder and edge along the edge of a piece of sheet metal 15 as shown in FIG. 6, the user merely has to assemble the jaw lug 27 of the device 10 which is formed to fit over the work face and two opposed sides of the upper jaw 24 of the said hand pliers 11 by means of the set screws 12 as shown in FIG. 1 and adjust the leverage and/or degree of closure by the adjustment means 26 provided on the said hand pliers 11. This said adjustment means 26 provided on the said hand pliers 11 enables a user to adjust the degree of closure of the lower jaw 25 of the said hand pliers 11, as shown in FIG. 4B, to allow the device 10 to accept varying guages of sheet metal and this said adjustment also allows the said user to adjust the degree of closure of the said lower jaw 25 of the said hand pliers 11 to form varying depths of offset edge when the offset shoulder and edge is formed as shown in FIG. 5.

Figure 2:
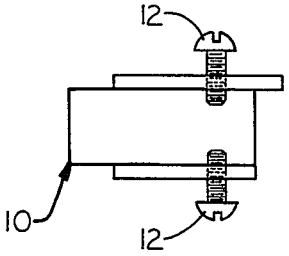
FIG. 2 is a bottom view of this present device.

FIG. 2 is a bottom view of the device 10 showing the opposition of the two adjustable set screws 12, which are tightened against the upper jaw 24 of the said hand pliers 11.

Figure 3:
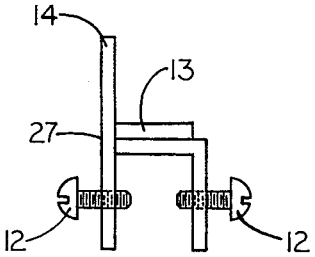
FIG. 3 is a back view of this present device.

FIG. 3 is a rear view of the device 10 showing the two opposed set screws 12, the work stop 14 and the offset shoulder and edge forming shelf 13.

Figure 4A:
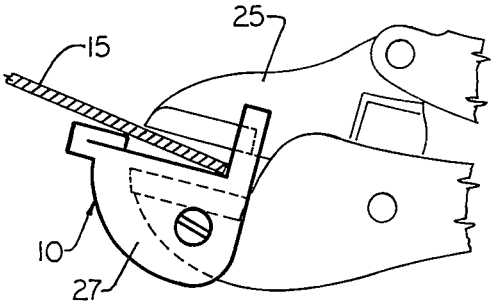
FIG. 4A is a side view of this present device affixed to the upper jaw of the said hand pliers showing a side view of a piece of sheet metal inserted between the said jaw and the opposed lower jaw of the said hand pliers up to the work stop before pressure is applied to the said hand plier jaws.

FIG. 4A is a side view of the device 10 affixed to the upper jaw 24 of said hand pliers 11 in an inverted position showing a side view of a piece of sheet metal 15 inserted up to the work stop 14 and the said piece of sheet metal 15 is shown before pressure is applied to the jaws of the said hand pliers 11.

FIG. 4B is the same view as seen in FIG. 4A, but shows the side view of the said piece of sheet metal 15 after pressure has been applied to the jaws of the said hand pliers 11. FIG. 4B also shows how the width of the offset shoulder 19 and edge 20 of the said piece of sheet metal 15 is automatically controlled by the said work stop 14. Also shown in FIG. 4B, the radius of the offset shoulder 19 can be either shortened or lengthened at the will of the user by loosening the set screw 12 and moving the device 10 backward or forward on the upper jaw 24 of the said inverted hand pliers 11 causing the space between the edge forming shelf 13 and the lower jaw 25 of the said inverted hand pliers 11 to increase or decrease at the will of the said user.

FIG. 5 is a cutaway side view of a piece of automobile body sheet metal 15 with a hole in the said piece of sheet metal 15. As shown in FIG. 5, the edge 20 surrounding the circumference of the said hole in the said piece of sheet metal 15 has been worked by this present device 10 as shown in FIG. 4B to form an offset shoulder 19 with depressed edge 20 to the exact depth needed to affix sheet metal patch 16 in perfect alignment with the surface contour of the said piece of sheet metal 15. As shown in FIG. 5 both sheet metal patch 16 and the piece of sheet metal 15 have corresponding holes 18 and similar hole in the patch drilled through the metal along the circumference of each, and the upper surface of the said sheet metal patch 16 also has three holes countersunk by suitable means so that the heads of the attaching rivets 17 are depressed below the surface contour of the said sheet metal patch 16. As shown in FIG. 5, the general contour of the surface of the said sheet metal patch 16 and the said piece of sheet metal 15 are the same and the only areas needing body filler are the aperture 23 surrounding the sheet metal patch, 16 and the said countersunk holes into which the heads of the said rivets 17 are depressed.

Although this invention has been described in it's preferred form with a certain degree of particularity, it is understood that the present disclosure of the preferred form has been made only by way of example and that numerous changes in the details of construction and the combination and arrangement of parts may be resorted to without departing from the spirit and the scope of the invention.

What is claimed is:

1. A device for forming an offset shoulder and depressed parallel edge along the outside perimeter of a hole in the sheet metal of an automobile body, said device being adapted for use with a standard compound acting adjustable vise type of hand pliers, having a first upper pan and a second lower jaw, comprising:

jaw lug means constructed as part of said device, said jawing means being positioned on the upper jaw of the said hand pliers, attaching means securing the said jaw lug means to the said upper jaw of the said hand pliers, work stop means located to allow the formation of said offset shoulder and edge in said piece of sheet metal, in an evenly contoured shape at a predetermined distance from said edge, said attachment means including adjustment means wherein the formation of said offset shoulder and edge in said piece of sheet metal can be adjusted to have a longer or shorter offset radius according to the needs of a workman.

2. A device as set forth in claim 1, wherein:

said jaw lug means is formed to fit over the work face and two opposed sides of the upper jaw of the said hand pliers in opposed engagement with the lower jaw of said hand pliers, an offset shoulder forming shelf means formed as an integral part of the said jaw lug means with the said shelf means being formed on a front portion of the device, said shelf means being positioned forward of the said lower jaw when the said jaw lug means is secured into work position on the said upper jaw of the said hand pliers, said jaw lug means includes a leg portion extending along each of the opposed sides of the said upper jaw of the said hand pliers, and said work stop means being formed as an integral part of the said jaw lug means.

3. A device as set forth in claim 1, wherein:

said attaching means comprises;

a leg portion of said jaw lug means extending along each of the opposed sides of the said upper jaw of the said hand pliers, said attaching means having a threaded set screw means extending through each said leg portion to contact the opposed sides of the said upper jaw of the said hand pliers to securely attach the said jaw lug means to the said upper jaw of the said hand pliers.

4. A device as set forth in claim 1, wherein:

said work stop means is formed as an integral part of the said jaw lug means to enable the insertion of the sheet metal work piece between the two opposed jaws to be easily maintained in a constant work position in which the said work can be performed in an evenly contoured shape.

5. A device as set forth in claim 1, wherein:

said jaw lug means is secured to the said upper jaw of the said hand pliers by two set screw means extending through leg portions of the said jaw lug means to contact the opposed sides of the said upper jaw of the said hand pliers to securely attach the said jaw lug means to the said upper jaw of the said hand pliers, said jaw lug means includes an offset shoulder forming shelf means which is positioned forward of the lower jaw closure when the said jaw lug means is secured into work position on the said upper jaw of the said hand pliers, said adjustment means permitting the position of the said shelf means to be increased or decreased relatively to said lower jaw by loosening one of the said set screw means extending through one of said leg portions of the said jaw lug means and sliding the said jaw lug means forward or backward on the said upper jaw of the said hand pliers to increase or decrease forward positioning of the said shelf means of the said jaw lug means and then tightening the said loosened set screw means to again contact in a secure manner the said upper jaw of the said hand pliers to hold the said jaw lug means in the forward position needed to achieve the offset shoulder radius needed by the said workman.

* * * * *